US007574819B2

(12) United States Patent
Rie

(10) Patent No.: US 7,574,819 B2
(45) Date of Patent: Aug. 18, 2009

(54) SHOE FOR LADIES WITH MULTI HIGH HEELS

(76) Inventor: Jin Rie, 401 N. Bixel St., Los Angeles, CA (US) 90026

( * ) Notice: Subject to any disclaimer, the term of this patent is extended or adjusted under 35 U.S.C. 154(b) by 602 days.

(21) Appl. No.: 11/517,470

(22) Filed: Sep. 8, 2006

(65) Prior Publication Data

US 2008/0060226 A1 Mar. 13, 2008

(51) Int. Cl.
*A43B 13/14* (2006.01)
*A43B 21/24* (2006.01)

(52) U.S. Cl. ..... 36/99; 36/34 R; 2/966

(58) Field of Classification Search ..... 36/99, 36/34 R; D2/965, 966
See application file for complete search history.

(56) References Cited

U.S. PATENT DOCUMENTS

| | | | | | |
|---|---|---|---|---|---|
| 2,284,326 | A | * | 5/1942 | Korda | 36/34 A |
| D136,960 | S | * | 1/1944 | Shuford | D2/965 |
| 2,414,445 | A | * | 1/1947 | Cahill | 36/149 |
| 2,934,840 | A | * | 5/1960 | Mistraz | 36/34 R |
| D201,002 | S | * | 5/1965 | Hahn | D2/966 |
| 3,369,309 | A | * | 2/1968 | Brooks | 36/99 |
| D347,937 | S | * | 6/1994 | Garland | D2/965 |

* cited by examiner

*Primary Examiner*—Ted Kavanaugh

(57) ABSTRACT

A high heel for women is provided. The high heels according to the current invention have at least two tall heels fixed to rear end of the bottom of sole of the shoes. Each heel is fixed to the sole with a pin. Each heel is in a shape of concavely curved narrow vertical column whose upper end is flat and wider than the lower end. In case of two heeled shoes, two upper ends of the heels, met at the bottom of the sole, provide an ornament rear view of an arch. The multi heeled high heels according to current invention reduces dislocation of wearer's ankle though the heels are narrow and long.

2 Claims, 8 Drawing Sheets

SHOE FOR LADIES WITH MULTI HIGH HEELS

FIELD OF THE INVENTION

Current invention is related with a ladies high heels, especially related with a high heel that has at least two very tall heels.

BACKGROUND OF THE INVENTION

Dress up or made up is very important in social life to give impression to other people. Especially for young ladies of twenties and thirties or even forties, dress up is critical to find their mates. Some young ladies even take risks of doing plastic surgeries to their body if she can make "the one" as her mate. For them, shoes, cloths, jewelry, and adornments are less dangerous means to get attraction from "the one". Shoes, especially high heels, have some special functions. It makes a wearer look taller than the real height of the wearer. Therefore, many young ladies, who want to be looked taller, wear high heel with very tall heel. The other function of high heels is that it has strong attraction power for some male adult. So, most of high heels are designed ornamentally and many of them have very narrow heel body and tip. However, due to the thickness of the heel there is limit in increasing the height of a heel. To avoid such limitation, high heels with one body heel that covers from toe portion to heel portion of shoes is provided. That can be called as 'sloped sole'. However, unfortunately, many adult male do not think that such design is ornament. If a young lady wears a high heel that is very tall and the heel shape is narrow, she can easily dislocate her ankle. It may be charming but dangerous. It is purpose of the current invention to provide a high heel for ladies.

DESCRIPTION OF THE PRIOR ART

U.S. Pat. No. D517,293 to Choi illustrates a decorative heel brace for a ladies high heel. The decorative heel brace is a carved string of solid material. Inside of the brace is empty and the brace supports a heel that is comprised of a thin curved plate.

U.S. Pat. No. 6,694,647 to Patterson, et al. illustrates a golf shoe including an outsole having a sole member. The sole member has a sole, a heel, and an arch disposed intermediate the sole and heel. The sole and heel each have a ground engagement surface. The heel has a centerline and left and right side portions disposed on either side of the centerline. The left side portion of the heel (the medial side portion for the right golf shoe and the lateral side portion for the left golf shoe) includes a flare having a ground engagement surface. The ground engagement surfaces of the flare and left side portion of the heel have an area which is greater than the area of the ground engagement surface of the right side portion of the heel.

U.S. Pat. No. 4,566,206 to Weber illustrates an undamped spring, having multi-spring rates, which is provided in the heel support portion of a shoe for resiliently compressing under heel pressure against the ground and returning a substantial portion of the energy of the pressure to the wearer's foot. The spring is formed of upper and lower leaf-like legs which are integrally joined together at an acute angle whose apex is directed forwardly relative to the shoe. An intermediate leaf-like leg is located between and integrally joined with one and extended towards the other of the upper and lower legs. Thus, heel pressure compresses the upper leg towards the lower leg until the intermediate leg is engaged and, thereafter, spring compression continues at an increased spring rate.

U.S. Pat. No. D262,583 illustrates a heel combined sole for women shoes. The shoes is comprised of very tall heel and a thin sole. A decorative support is located between the toe side of the heel and arch portion of the sole. The supports reinforce the arch portion of the shoe.

U.S. Pat. No. 4,245,407 to Mazabras illustrates an arch and heel assembly for shoes having an arch and a heel secured to each other at their upper ends. A connecting link has its front end secured to the base of the arch and its rear end secured to the base of the heel to define a substantially triangular open area between the arch, the heel and the connecting link.

U.S. Patent Application 20010034957 to Doerer, Daniel M., et al. illustrates a shoe heel that includes a rigid heel block that attaches to a shoe sole at the heel seat on the sole and a top lift having a molded base that is located below the heel block such that a space exists between the bottom of the block and the top of the base. This space, along the peripheries of the block and base, contains a highly resilient skirt, the interior of which is for the most part a void. An elastomeric slug projects from the heel block, through the space, and at its lower end bears against the base of the top lift. The slug, while being resilient, possesses enough firmness to support the weight of an individual over the base of the top lift. The top lift contains pins which project from its base into bores in the heel block to prevent the top lift from rotating under the heel block. The slug, while transferring the weight of the individual to the top lift, attenuates impacts to which the top lift is subjected.

None of the prior art illustrates a high heel that has multi heels to stabilize a very tall high heels for a women user who wants to wear a high heel that is tall, stable and beautiful.

SUMMARY OF THE INVENTION

Dress up or made up is very important in social life to give impression to other people. Especially for young ladies of twenties and thirties or even forties, dress up is critical to find their mates. Some young ladies even take risks of doing plastic surgeries to their body if she can make "the one" as her mate. For them, shoes, cloths, jewelry, and adornments are less dangerous means to get attraction from "the one". Shoes, especially high heels, have some special functions. It makes a wearer look taller than the real height of the wearer. Therefore, many young ladies, who want to be looked taller, wear high heel with very tall heel. The other function of high heels is that it has strong attraction power for some male adult. So, most of high heels are designed ornamentally and many of them have very narrow heel body and tip. However, due to the thickness of the heel there is limit in increasing the height of a heel. To avoid such limitation, high heels with one body heel that covers from toe portion to heel portion of shoes s vidd. That can be called as 'sloped sole'. However, unfortunately, many adult male do not think that such design is ornament. If a young lady wears a high heel that is very tall and the heel shape is narrow, she can easily dislocate her ankle. It may be charming but dangerous. It is purpose of the current invention to provide a high heel for ladies. The high heels according to the current invention have at least two tall heels fixed to rear end of the bottom of sole of the shoes. Each heel is fixed to the sole with a pin. Each heel is in a shape of concavely curved narrow vertical column whose upper end is flat and wider than the lower end. In case of two heeled shoes, two upper ends of the heels, met at the bottom of the sole, provide an ornament rear view of an arch. The multi heeled high heels according to current invention reduces dislocation of wearer's ankle though the heels are narrow and long.

DETAILED DESCRIPTION OF THE PREFERRED EMBODIMENT

Figure 1:
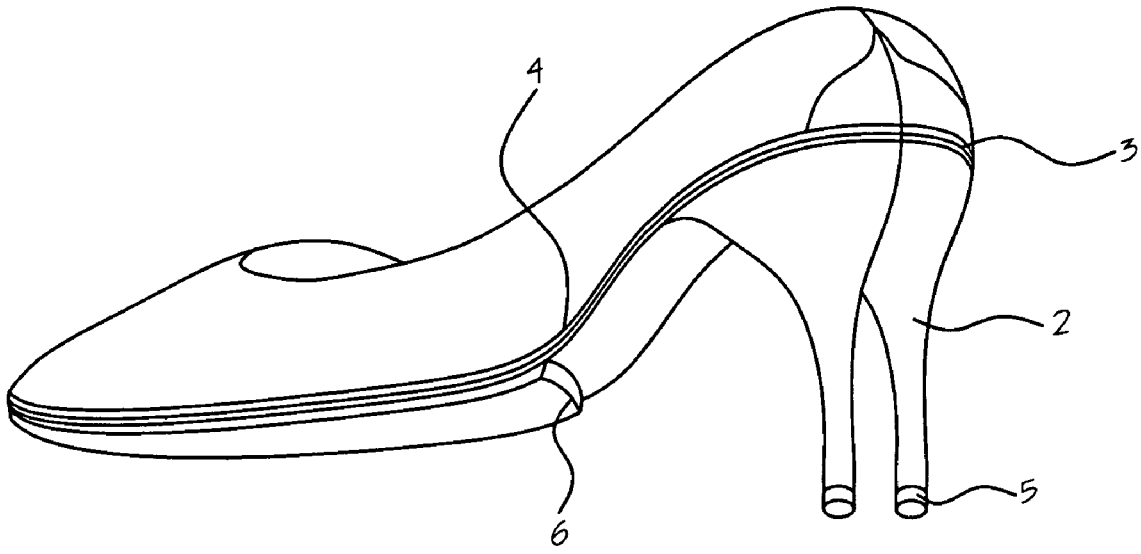
FIG. 1 is a perspective view of a high heel having two heels according to the current invention seen from rear bottom.

FIG. 1 is a perspective view of a high heel (1) having two heels (2) according to the current invention seen from rear bottom. The two heels (2) are same shape and of same size. Upper parts of the heels are broad and lower parts (2-6) are narrow and long. Overall shape is concavely curved 'martini glass.' Each heel has similar structure of normal high heels. Upper end of the two heels are secured to a heel seat (3) that is fixed to the heel portion of a sole (4). Lower end of the heels are reinforced with tips (5). It is the purpose of the current invention to provide a high heel that raises height of a wearer over 10 cm without sacrificing safety and ornament appearance of the high heel. Additional front half sole (6) protects the sole (4) of the high heel (1).

Figure 2:
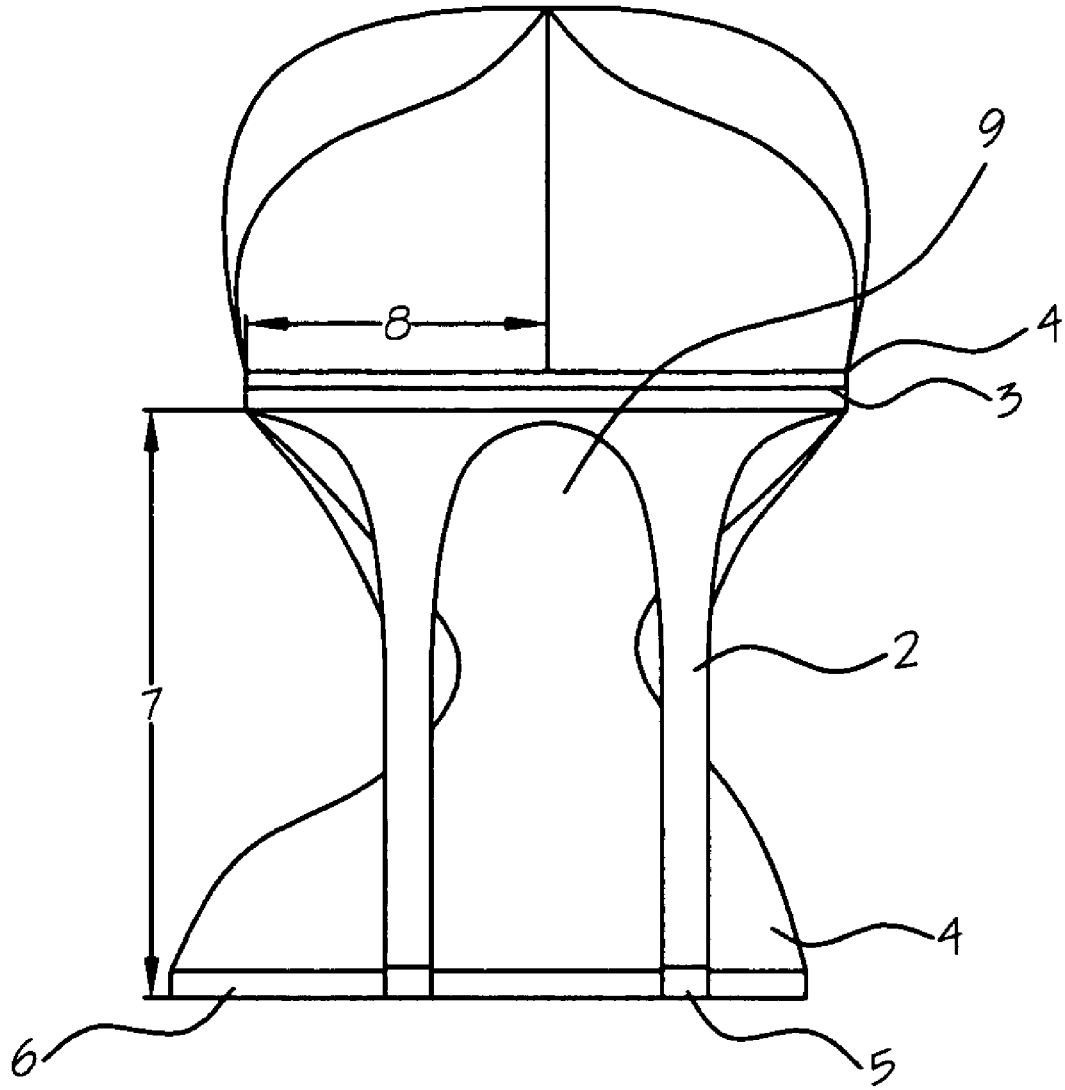
FIG. 2 is a rear view of a high heel having two heels according to the current invention.

FIG. 2 is a rear view of a high heel (1) having two heels (2) according to the current invention. The two heels (2) have same geometry. Therefore, height (7) and width (8) of the two heels (2) are the same. The two heels (2) meet at the center of the heel seat (3). The same height (7) of the two heels (2) makes the heel seat (3) of the high heel (1) in a horizontal position to the ground. It makes a user's leg positioned up right, which was impossible with one heeled high heel of previous technology. In single heeled high heels, there is limit to increase the height of the heel which has broad top and sharp tip, a 'martini glass' shape. If the height of the one heel is over 10 cm, the wearer may dislocate or break the ankle. To avoid such limitation, a thick and bulky single heel is introduced for very high heels for ladies. But, the thick and bulky heel is gross and heavy compared to the normal slim heel. Therefore, the thick heel's function is limited to just raise the wearer's height. Meanwhile, the shape of the two heels (2) meet at the center of the heel seat (3) creates an ornament shape of an arch window (9). This rear shape is entirely new design in high heel.

Figure 3:
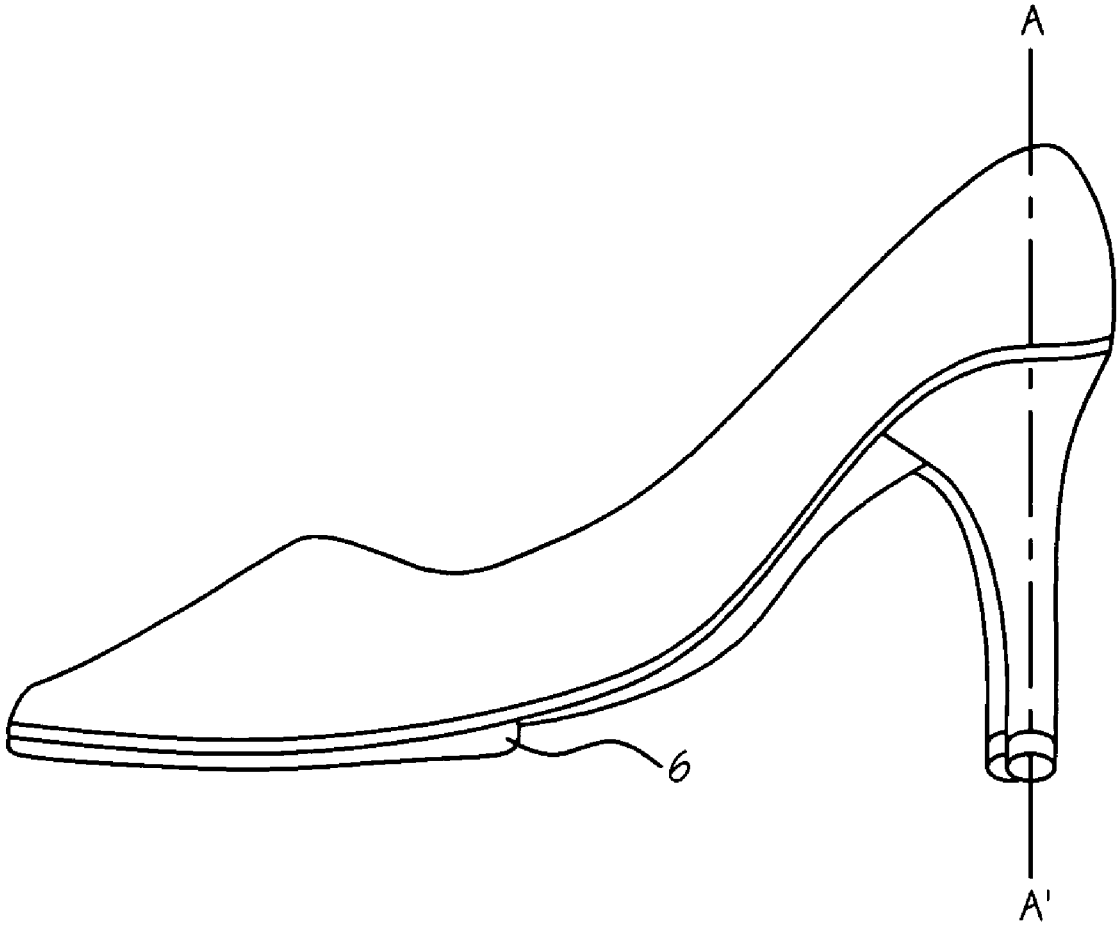
FIG. 3 is a side view of a high heel having two heels according to the current invention.

FIG. 3 is a side view of a high heel (1) having two heels (2) according to the current invention. Due to the stability of the two heeled high heel (1) of the current invention, height of the heel can increased well over 10 cm. Side silhouette of the heel becomes more fascinate than other thick bulky heeled ladies shoes. Two heels, supporting the shoes, stabilize the shoes while maintaining the beauty of the ladies shoes. Additional front half sole (6) aids to raise the height of the high heel (1) according to the current application.

Figure 4:
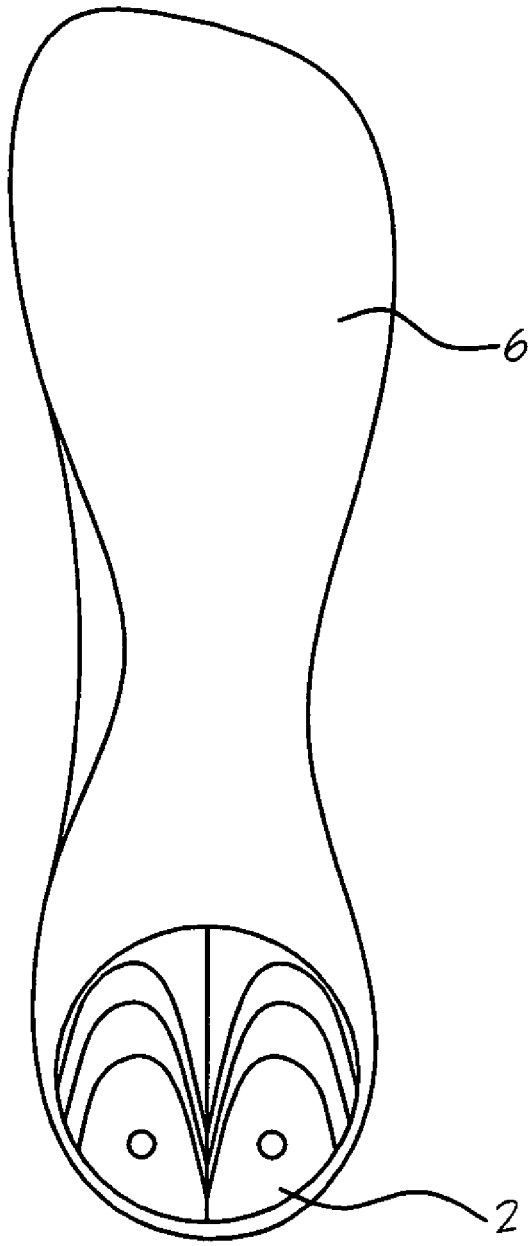
FIG. 4 is a bottom view of a high heel having two heels according to the current invention.
Figure 5:
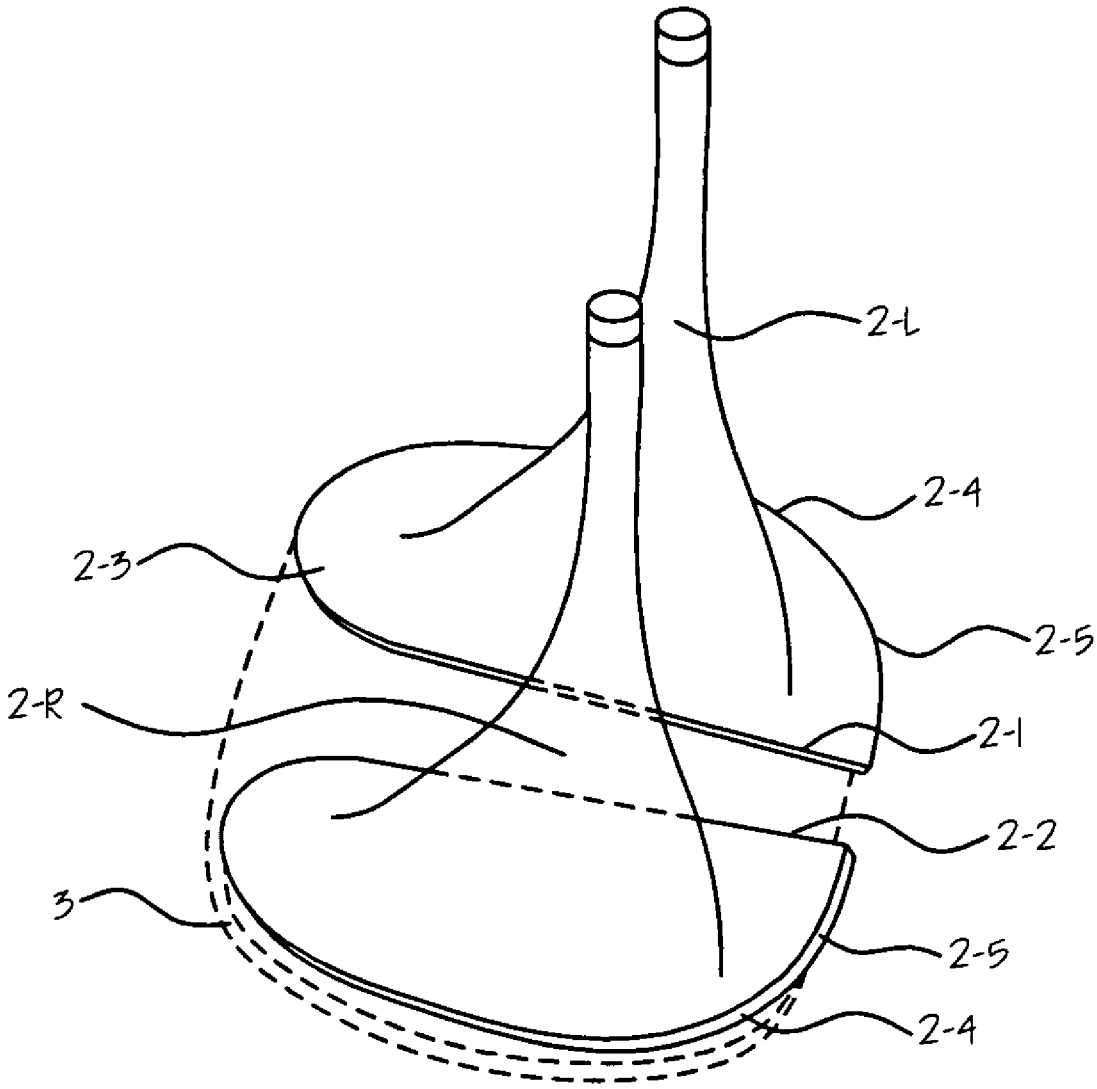
FIG. 5 is a perspective up-down view of one heel for a high heel having two heels according to the current invention.

FIG. 4 is a bottom view of a high heel (1) having two heels (2) according to the current invention. To realize the ornament shape of the heels and safety of the high heel (1), the shape of the heels (2) is different from normal single heel. FIG. 5 is a perspective upside-down view of the heels of a high heel (1) having two heels (2) according to the current invention. (2-L) indicates left heel and (2-R) indicates right heel. Right side (2-1) of top of the left heel (2-L) is flat to meet another flat side of left side (2-2) of top of the right heel (2-R). Other perimeters of the top of both heels (2-R) and (2-L) are rounded. Rear side perimeter (2-3) of both of the heels (2-R) and (2-L) are rounded with short radius. Therefore, the rear side perimeters (2-3) of the heels (2-R) and (2-L) do not align with the rear perimeter of the heel seat (3). Meanwhile, the outside perimeter (2-4) and the front side perimeter (2-5) align with the perimeter of the heel seat (3).

Figure 6:
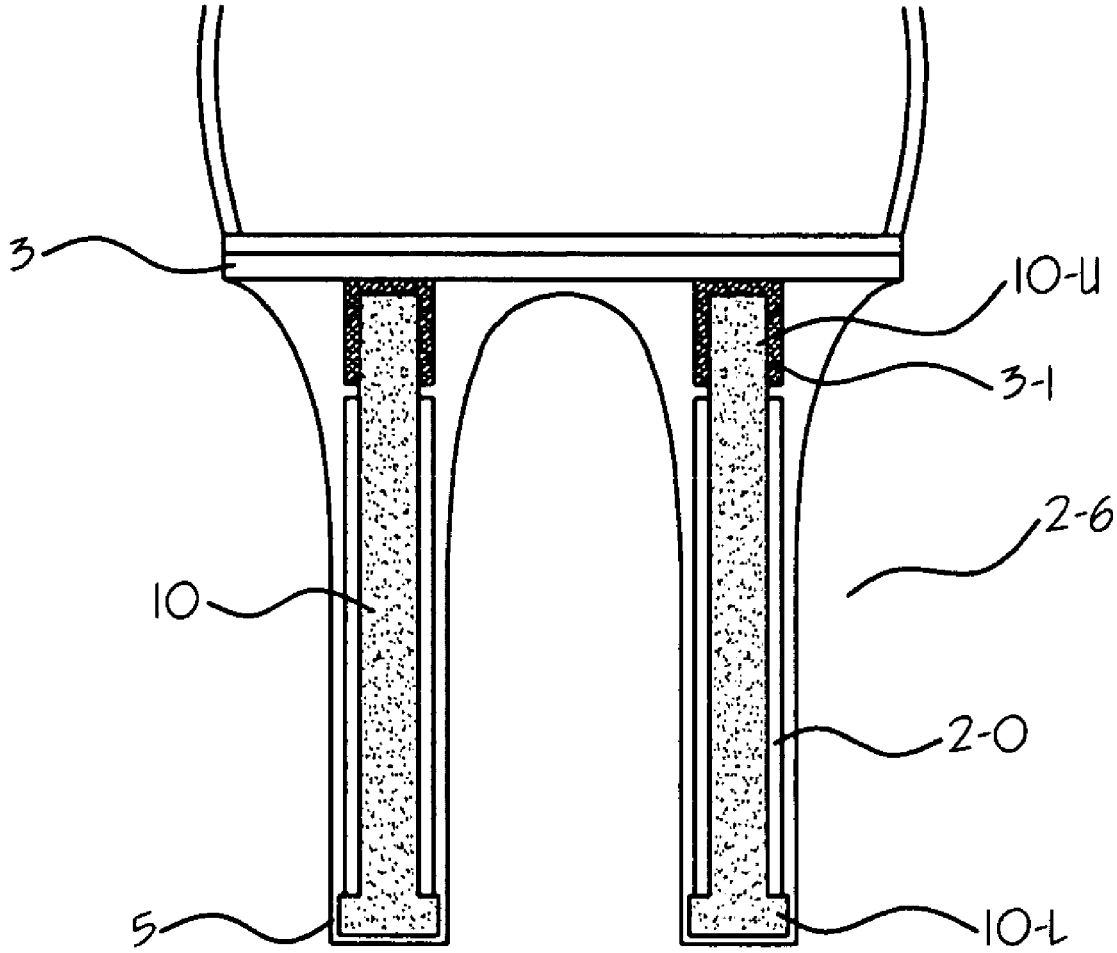
FIG. 6 is a cross sectional view taken along line A-A' of FIG. 3.
Figure 7:
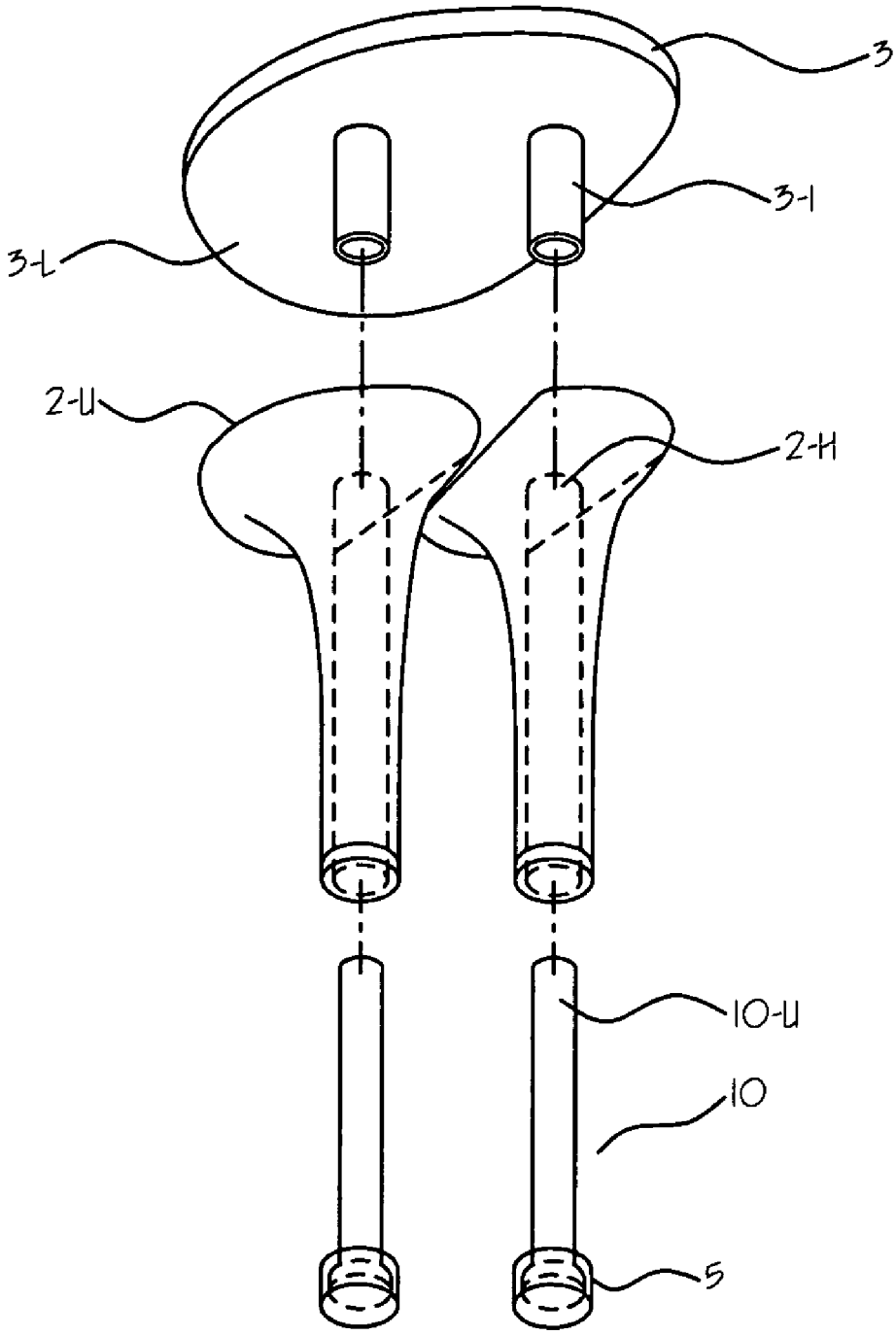
FIG. 7 is an exploded perspective view of the heel.

FIG. 6 is a cross sectional view taken along line A-A' of FIG. 3. And FIG. 7 shows an exploded perspective view of the heels (2). As the shape of the heels (2) of the current application have a long narrow lower part (2-6), especially over 10 cm, the heels (2) are reinforced by solid metal pins (10). Lower end (10-L) of the metal pins (10) are embedded in the tip (5) of the heels (2) and glued to fix them. The pins pass through holes (2-H), which are vertically developed through out the whole heels (2), and upper end (10-U) of the metal pins (10) are engaged to metal grooves (3-1). The grooves (3-1) are fixed to the heel seat (3) with proper means. Since inside of the heels (2) are reinforced by metal pins (10), outer body (2-0) of the heels (2) is comprised of flexible material such as polyurethane, silicon, and EP rubber. Upper end surface (2-U) of the heels (2) are fixed to the lower surface (3-L) of the heel seat (3) with glue.

The structure of heels (2), shown above, enables manufacturing a ladies' high heel that maintains ornament design, stability and strength at the same time when height of the heel is longer than 10 cm.

Figure 8:
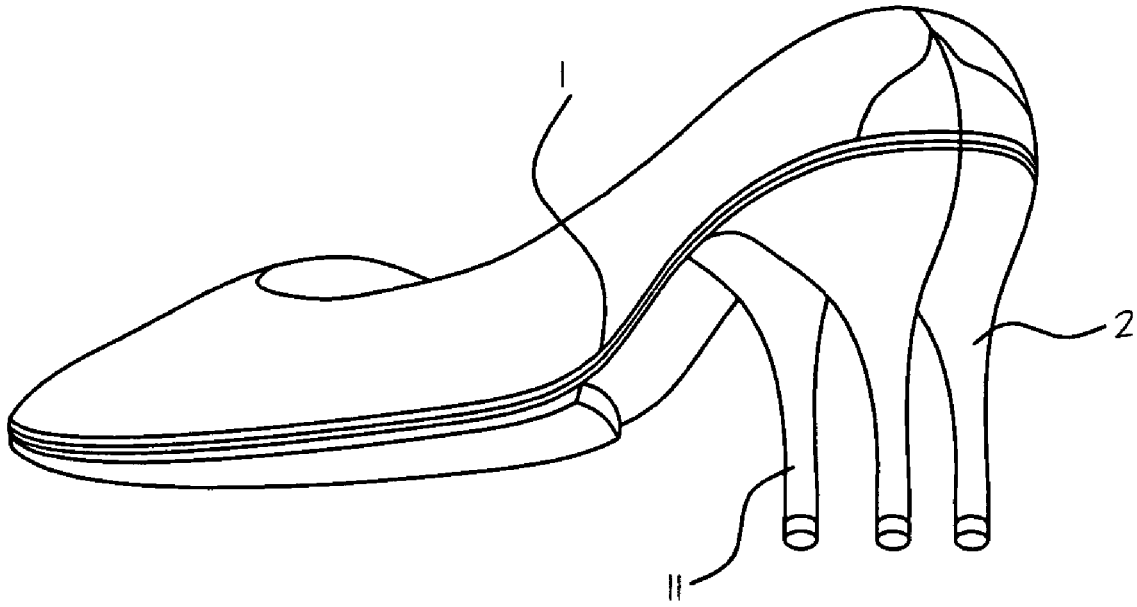
FIG. 8 is a perspective view of a high heel having three heels, another embodiment according to the current invention, seen from rear bottom.

Number of heels for ladies high heel according to the current application is not limited to 2. FIG. 8 is a perspective view of a high heel having three heels, another embodiment according to the current invention, seen from rear bottom. The third heel (11) supports mid sole part of the high heel. Like wise, number of heels can be increased up to 5.

What is claimed is:

1. A high heels for women to reduce chance of dislocation of wearer's ankle though the heels are narrow and long and to provide a high heel that raises height of a wearer over 10 cm without sacrificing safety and ornament appearance of the high heels is comprises of:

- two heels each of them is longer than 10 cm and
  - has same shape of mirror image and
  - is of same size and
  - upper part of each of them is broad and
  - lower part of each of them is narrow and long and
  - upper end of each of them is secured to a heel seat that is fixed to the heel portion of a sole and
  - lower end of each of them is reinforced with tips and
  - upper end of the two heels meet at the center of the heel seat and
  - right side of top of a left heel is flat to meet another flat side of left side of top of a right heel and
    - other perimeters of top of both heels are rounded and
    - rear side perimeter of both of heels are rounded with short radius and
    - outside perimeter and front side perimeter align with perimeter of the heel seat and
- the two heels are reinforced by solid metal pins and
  - lower end of the metal pins are embedded in the tips of the heels and glued and
    - the pins pass through holes, which are vertically developed through out the whole heels and
  - upper end of the metal pins are engaged to metal grooves, which are fixed to the heel seat with proper means, and
  - outer body of the heels is comprised of flexible material.

2. A high heel for women of claim 1, wherein the number of heels are three.

* * * * *